United States Patent [19]

Goto

[11] Patent Number: 4,834,006

[45] Date of Patent: May 30, 1989

[54] EMBROIDERY FRAME SUPPORTING DEVICE FOR AN EMBROIDERY SEWING MACHINE

[75] Inventor: Hisaharu Goto, Nagoya, Japan

[73] Assignee: Aisin Seiki Kabushiki Kaisha, Kariya, Japan

[21] Appl. No.: 192,618

[22] Filed: May 11, 1988

[30] Foreign Application Priority Data

May 11, 1987 [JP] Japan ..... 62-069965[U]

[51] Int. Cl.[4] ..... D05C 9/04

[52] U.S. Cl. ..... 112/103; 112/86

[58] Field of Search ..... 112/103, 102, 86, 90, 112/121.11, 121.12, 121.15

[56] References Cited

U.S. PATENT DOCUMENTS 3,405,670 10/1968 Scholl et al. ..... 112/102 X
3,664,288 5/1972 Von Boden et al. ..... 112/103
4,280,420 7/1981 Nishida et al. ..... 112/103

*Primary Examiner*—H. Hampton Hunter

*Attorney, Agent, or Firm*—Oblon, Fisher, Spivak, McClelland & Maier

[57] ABSTRACT

An embroidery frame supporting device includes a frame member having either a fixing screw or a ferromagnetic plate, a driving mechanism for travelling in a two dimensional plane, a carriage member for supporting the frame members and for transmitting the movement of the driving mechanism to the frame member, a yoke member fixed to the carriage member, a magnetic member fixed to the yoke member, and a recess provided on the carriage member and engaging with the fixing screw. When a large or heavy frame member is fixed to the carriage member, the fixing screw is inserted into the recess. Thus, the large frame member is fixed to the carriage member with a suitable supporting force. Further, when a small frame member is fixed to the carriage member, the small or light frame member is attracted by the magnetic force of the magnet member. Thus, the small frame member is fixed to the carriage member with suitable supporting force.

5 Claims, 4 Drawing Sheets

EMBROIDERY FRAME SUPPORTING DEVICE FOR AN EMBROIDERY SEWING MACHINE

BACKGROUND OF THE INVENTION

1. Field of the Invention

The present invention relates to an embroidery frame supporting device which fixes an embroidery frame to a frame driving mechanism of an embroidery sewing machine.

2. Background of the Related Art

U.S. Pat. No. 4,280,420 published on July 28, 1981 discloses an embroidery sewing machine with a detachable embroidery frame. According to this specification, the embroidery frame is fixed to a driving mechanism by a supporting device which has a ferromagnetic plate and a permanent magnet.

However, the conventional supporting device does not have enough supporting force between the frame and the driving mechanism. Therefore, when a large or heavy embroidery frame is fixed to the driving mechanism by the conventional supporting device, an embroidery pattern is deformed due to the lack of the sufficient supporting force.

SUMMARY OF THE INVENTION

Accordingly, an object of the present invention is to obviate above conventional drawbacks.

Further, an object of the present invention is to support an embroidery frame with enough supporting force.

Furthermore, an object of the present invention is to permit easy detachment of an embroidery frame.

Yet a further object of the present invention is to support an embroidery frame with suitable supporting force in response to a characteristic of the embroidery frame.

To achieve the above objects, an embroidery frame supporting device according to the present invention comprises a frame member having at least one of a fixing screw and a ferromagnetic plate, a driving mechanism for travelling in a two dimensional plane, a carriage member for supporting the frame member and for transmitting the movement of the driving mechanism to the frame member, a yoke member fixed to the carriage member, a magnetic member fixed to the yoke member, and a recess provided on the carriage member and engaging with the fixing screw.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
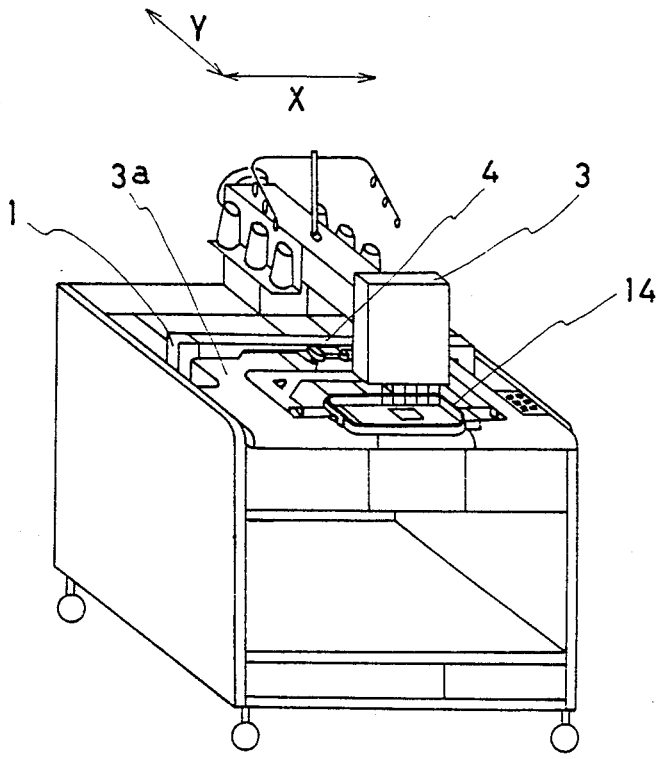
FIG. 1 is a perspective view of an embroidery sewing machine which utilizes a frame supporting device according to the present invention.

In FIG. 1 a driving mechanism (1) is provided on a bed (3*a*) of an embroidery sewing machine (3). The driving mechanism (1) includes two D.C. motors which are driven by a control circuit (not shown) of the sewing machine (3) in a synchronous manner with the up and down reciprocation of a sewing needle (not shown). One of the motors drives a carriage member (4) mounted on the driving mechanism (1) for travel on the bed (3*a*) along X-axis illustrated in FIG. 1: The other motor drives the entire driving mechanism (1) for travel on the bed (3*a*) along Y-axis which is perpendicular to the X-axis. A large embroidery frame (14) is fixed to the carriage member (4). Accordingly, when the driving mechanism (1) and the carriage member (4) are driven, the embroidery frame (14) travels on the bed (3*a*) along the X and Y axes.

Figure 2A:
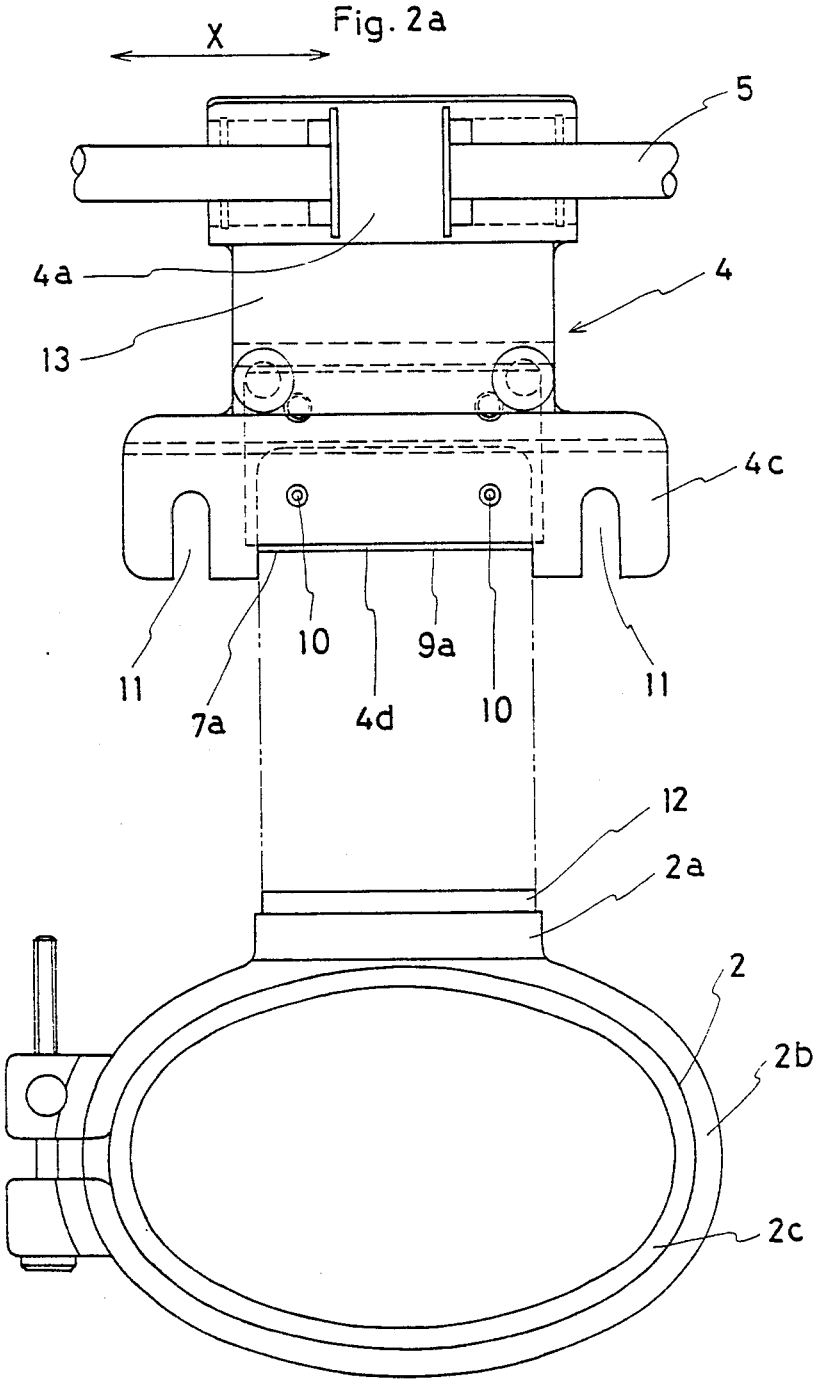
FIG. 2*a* is a plan view of a carriage member and a small embroidery frame according to the present invention.

FIG. 2*a* is a plan view of the carriage member (4) and a small embroidery frame (2) according to the present invention. Further, FIG. 2*b* is a side view of the attachment of the carriage member (4) to the small embroidery frame (2).

Figure 2B:
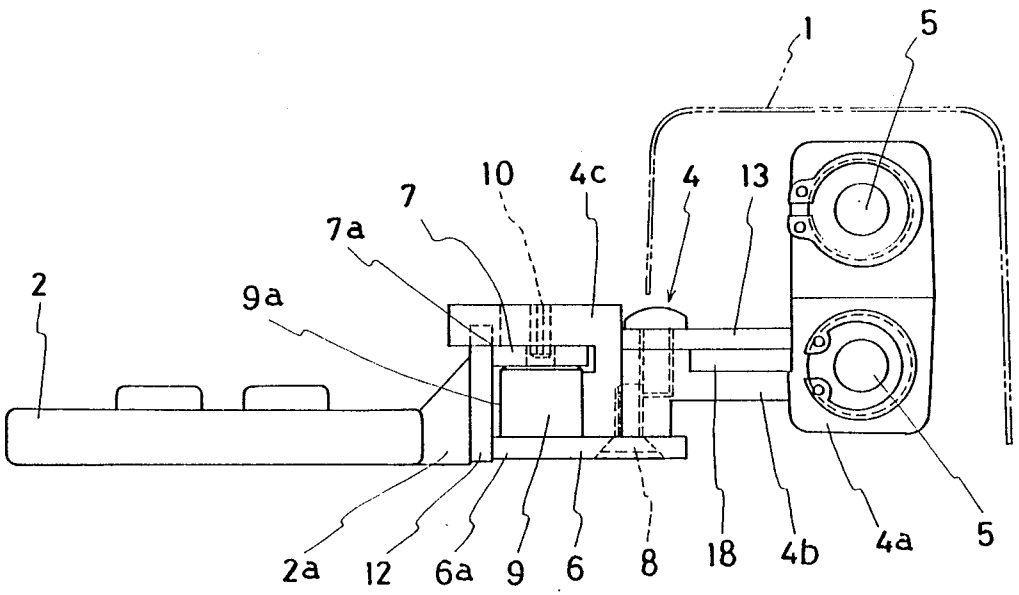
FIG. 2*b* is a side view of a carriage member attaching a small embroidery frame according to the present invention.

As shown in FIG. 2*b*, two guide rods (5) are inserted through the carriage member (4). The carriage member (4) travels in parallel with a surface of the bed (3*a*). The guide rods (5) are fixed to the driving mechanism (1).

The carriage member (4) is linked with a D.C. motor by a timing belt (not shown). The timing belt passes through a space (18) and is fixed on the carriage member (4) at a first member (4*a*) and a press member (13). Accordingly, when the motor is driven and the timing belt is rotated, the carriage member (4) travels along the guide rods (5).

The carriage member (4) includes the first member (4*a*), a second member (4*b*), a third member (4*c*), yoke plates (6) and (7), a permanent magnet (9) and the press member (13). The first member (4*a*), the second member (4*b*) and the third member (4*c*) are integrally formed of cast aluminum. Further, as shown in FIG. 2*a*, a second recess (4*d*) is formed on the middle of the third member (4*c*).

A first yoke plate (6) is fixed to a bottom surface of the second member (4*b*) by a screw (8). The yoke plate (6) is made of steel. A permanent magnet (9) is fixed on the yoke plate (6) by an adhesive. The permanent magnet (9) is also fixed to a side of the third member (4*c*).

A second yoke plate (7) is inserted between the top of the permanent magnet (9) and the third member (4*c*). The yoke plate (7) is fixed to the third member (4*c*) by two spring pins (10) and engages the permanent magnet (9). The yoke plate (7) has two small holes which have larger diameters than diameters of the spring pins (10).

Accordingly, the yoke plate (7) is capable of moving slightly with respect to the third member (4*c*).

The permanent magnet (9) has magnetic poles on both surfaces opposed to the yoke plates (6) and (7). Further, ends (6*a*) and (7*a*) of the yoke plates (6) and (7) project beyond a free side (9*a*) of the permanent magnet (9). Accordingly, when a ferromagnetic plate (12) fixed to extension portion (2*a*) of the frame (2) is inserted into the recess (4*d*) and abut yoke plates (6) and (7), the two yoke plates (6) and (7) connect the poles of the permanent magnet (9) magnetically with the ferromagnetic plate (12), so that a magnetically closed circuit is established around the permanent magnet (9). Therefore, the magnetic force of the permanent magnet (9) is used efficiently and the ferromagnetic plate (12) is strongly attracted to the yoke plates (6) and (7).

As described above, the yoke plate (7) is capable of moving slightly in the present embodiment. Therefore, when the ferromagnetic plate (12) is attracted to the yoke plates (6) and (7), the ends (6*a*) and (7*a*) of the yoke plates (6) and (7) are able to be positioned in a single plane. Accordingly, the ferromagnetic plate (12) is in close contact with both yoke plates (6) and (7).

As shown in FIG. 2*a*, the third member (4*c*) also has two elongated first recesses (11). The elongated recesses (11) open toward the same direction as the free side (9*a*) of the permanent magnet (9). Further, the spacing between the elongated recesses (11) is longer than the permanent magnet (9).

The small embroidery frame (2) comprises an inner ring (2*c*) and an outer ring (2*b*). A cloth to be sewn is pinched between the inner ring (2*c*) and outer ring (2*b*) and is stretched by the rings (2*b*) and (2*c*). The fixed extension portion (2*a*) is formed integrally with the outer ring (2*b*). The fixed extension portion (2*a*) is to be fixed to the carriage member (4).

The ferromagnetic plate (12) is fixed to the fixed extension portion (2*a*). The ferromagnetic plate (12) is attracted to the permanent magnet (9). As shown in FIG. 2*a*, the ferromagnetic plate (12) has substantially the same width as the recess (4*d*) provided on the third member (4*c*). Further, as shown in FIG. 2*b*, when the small embroidery frame (2) is fixed to the carriage member (4), the ferromagnetic plate (12) is inserted into the recess (4*d*).

As described above, when the small embroidery frame (2) is to be fixed to the carriage member (4), the position of the embroidery frame (2) is vertically set by the bed (3*a*) and horizontally set by the recess (4*d*). Then the embroidery frame (2) is attracted and fixed by the magnetic force of the permanent magnet (9).

As the size of the embroidery frame (2) becomes larger, a larger supporting force is required between the frame (1) and the carriage member (4) because of the increased mass of the embroidery frame (2). Accordingly, the large embroidery frame (14) (FIGS. 3*a* and 3*b*) is fixed to the carriage member (4) by engaging fixing screws (15) with the elongated recesses (11). The fixing screws (15) are provided on the large embroidery frame (14).

Figure 3B:
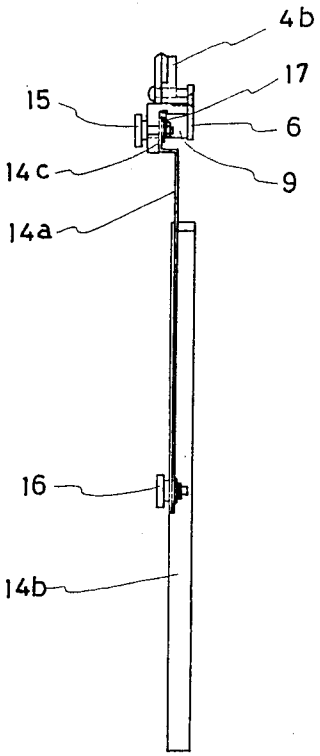
FIG. 3*b* is a side view of a carriage member engaging with a large embroidery frame according to the present invention.
Figure 3A:
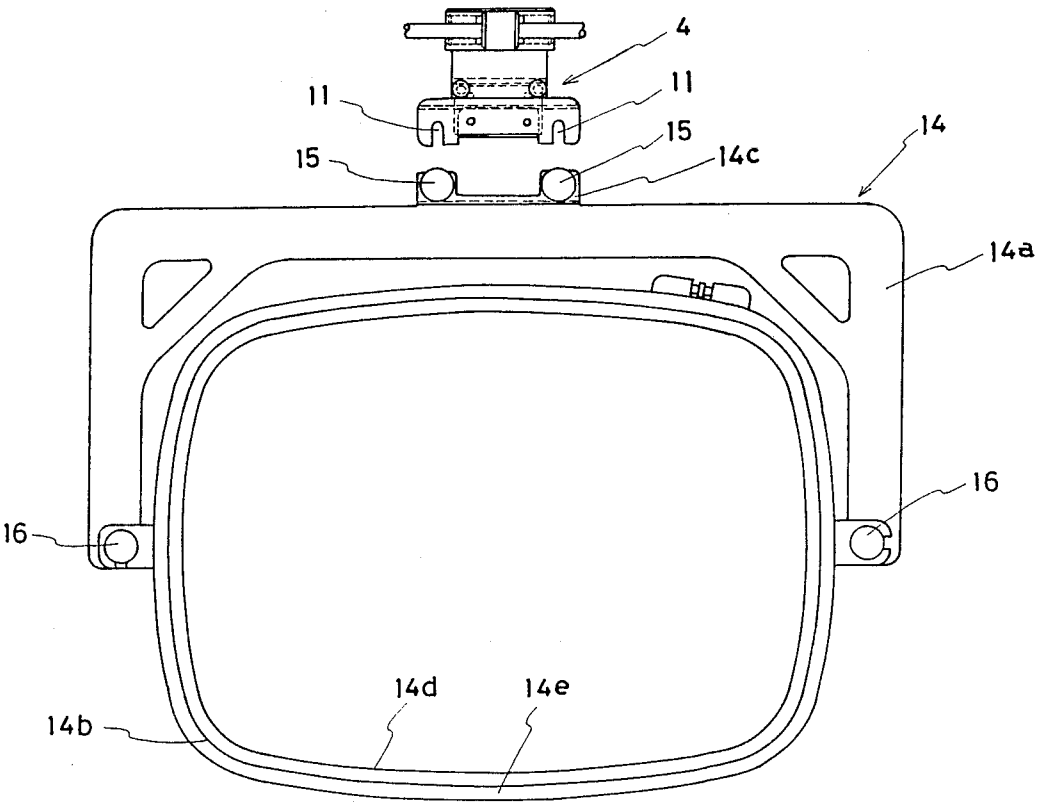
FIG. 3*a* is a plan view of a carriage member and a large embroidery frame according to the present invention.

FIG. 3*a* is a plan view of the carriage member (4) and the large embroidery frame (14) according to the present embodiment. FIG. 3*b* is a side view of the carriage member (4) engaging with the large embroidery frame (14) according to the present invention.

The large embroidery frame (14) has a stay (14*a*) and a ring part (14*b*). The ring part (14*b*) is fixed on the stay (14*a*) by two screws (16). Further, the ring part (14*b*) comprises an inner ring (14*d*) and an outer ring (14*e*). The cloth to be sewn is pinched between the inner ring (14*d*) and outer ring (14*e*) and is stretched by the rings (14*d*) and (14*e*).

A fixed portion (14*c*) is formed integrally with the stay (14*a*). The two fixing screws (15) are provided on the fixed portion (14*c*) in opposition to the two elongated recesses (11). Further, as shown in FIG. 3*b*, nuts (17) are fixed on the fixed portion (14*c*) by welding. The fixing screws (15) are engaged with the nuts (17).

When the large embroidery frame (14) is to be fixed to the carriage member (4), the two fixing screws (15) are inserted into the elongated recesses (11), then the fixing screws (15) are tightened. The elongated recesses (11) are pinched between the fixing screws (15) and the fixed portion (14*c*). Thus, the large embroidery frame (14) is fixed to the carriage member (4).

According to the present embodiment, the large embroidery frame (14) is fixed to the carriage member (4) with a large supporting force, because the large embroidery frame (14) is fixed by the fixing screws (15). Further, an embroidery frame which is deformed or vibrated easily by the movement of the carriage member (4) can be also fixed to the carriage member (4) with enough supporting force.

According to the invention, the cloth to be sewn is mounted on the embroidery frame (2) or (14) when the frames (2) and (14) are dismounted from the embroidery sewing machine (3). Therefore, a plurality of embroidery frames (2) and (14) loaded with cloths may be provided in order to improve the operating efficiency.

Obviously, numerous modifications and variations of the present invention are possible in light of the above teachings. It is therefore to be understood that within the scope of the appended claims, the invention may be practiced otherwise than as specifically described herein.

What is new and desired to be secured by letters patent of the United States is:

1. An embroidery frame supporting device, comprising:
   - a carriage member;
   - driving means for moving said carriage member in two directions in a plane;
   - an embroidery frame member; and
   - means for attaching said carriage member to said embroidery frame member, comprising:
     - (a) a first yoke member fixed to said carriage member,
     - (b) magnet means fixed to said yoke member,
     - (c) at least one first recess in said carriage member, and
     - (d) at least one of:
       - (i) a ferromagnetic plate fixed to said frame member at a position for magnetic attraction by said yoke member,
       - (ii) a fixing screw mounted on said frame member at a position for engagement with said first recess.

2. The device of claim 1 including a second yoke member engaging one pole of said magnet means, wherein said first yoke member is fixed to another pole of said magnet means, whereby said ferromagnetic plate may be magnetically attached to said first and second yoke members to support the embroidery frame.

3. The device of claim 1 including a second recess in said carriage member, said first and second yoke members projecting into said second recess.

4. The device of claim 1 wherein said means for attaching comprise two of said fixing screws, one of said fixing screw being fitted in each said first recess.

5. The device of claim 2 wherein said second yoke member is connected to said carriage member by means permitting limited relative movement therebetween.

* * * * *